US005624277A

United States Patent [19]

Ward

[11] Patent Number: 5,624,277

[45] Date of Patent: Apr. 29, 1997

[54] FILTERED AND SHIELDED ELECTRICAL CONNECTOR USING RESILIENT ELECTRICALLY CONDUCTIVE MEMBER

[75] Inventor: Bobby G. Ward, King, N.C.

[73] Assignee: The Whitaker Corporation, Wilmington, Del.

[21] Appl. No.: 520,221

[22] Filed: Aug. 28, 1995

[51] Int. Cl.[6] ..... H01R 13/66

[52] U.S. Cl. ..... 439/620

[58] Field of Search ..... 439/620, 607

[56] References Cited

U.S. PATENT DOCUMENTS

| | | | |
|---|---|---|---|
| 3,985,413 | 10/1976 | Evans | 339/17 LM |
| 4,356,532 | 10/1982 | Donaher et al. | 439/620 |
| 4,473,755 | 9/1984 | Imai et al. | 307/10 R |
| 4,600,256 | 7/1986 | Anttila | 339/17 M |
| 4,660,907 | 4/1987 | Belter | 339/14 R |
| 4,726,638 | 2/1988 | Farrar et al. | 439/620 R |
| 4,726,790 | 2/1988 | Hadjis | 439/620 |
| 4,729,752 | 3/1988 | Dawson, Jr. et al. | 439/620 |
| 4,930,200 | 6/1990 | Brush, Jr. et al. | 29/25.42 |
| 4,959,626 | 9/1990 | Mouissie | 333/182 |
| 5,133,678 | 7/1992 | Okamoto et al. | 439/620 |
| 5,141,455 | 8/1992 | Ponn | 439/620 |
| 5,151,054 | 9/1992 | Brionnes et al. | 439/620 |
| 5,152,699 | 10/1992 | Pfeifer | 439/620 |
| 5,340,334 | 8/1994 | Nguyen | 439/620 |
| 5,344,342 | 9/1994 | Briones | 439/620 |
| 5,415,569 | 5/1995 | Colleran et al. | 439/620 |

*Primary Examiner*—Neil Abrams
*Assistant Examiner*—Eugene Byrd

[57] ABSTRACT

A shielded and filtered electrical connector (2) includes surface mount capacitors (52) positioned in engagement with contact terminals (4) on the rear face (18) of a connector housing (10). A cylindrical electrically conductive member (36) having an elastomeric core (38) with a conductive laminate layer (42) on the exterior of a film (40) surrounding the elastomeric core (38) engages conductive ends (54) of each chip capacitor to urge it into contact with a corresponding contact terminal (4). The resilient electrically conductive member (36) is located in a central lateral channel (20) on the rear housing face (18) and the chip components (52) are located in pockets (24) between the channel (20) and corresponding terminals (4). The resilient electrically conductive member (36) and the chip components (52) are inserted using conventional pick and place techniques. A shield or ground member (26) surrounds the housing and the sides of the shield (26) trap the ends of the resilient electrically conductive member (36) to form a stable connection.

8 Claims, 9 Drawing Sheets

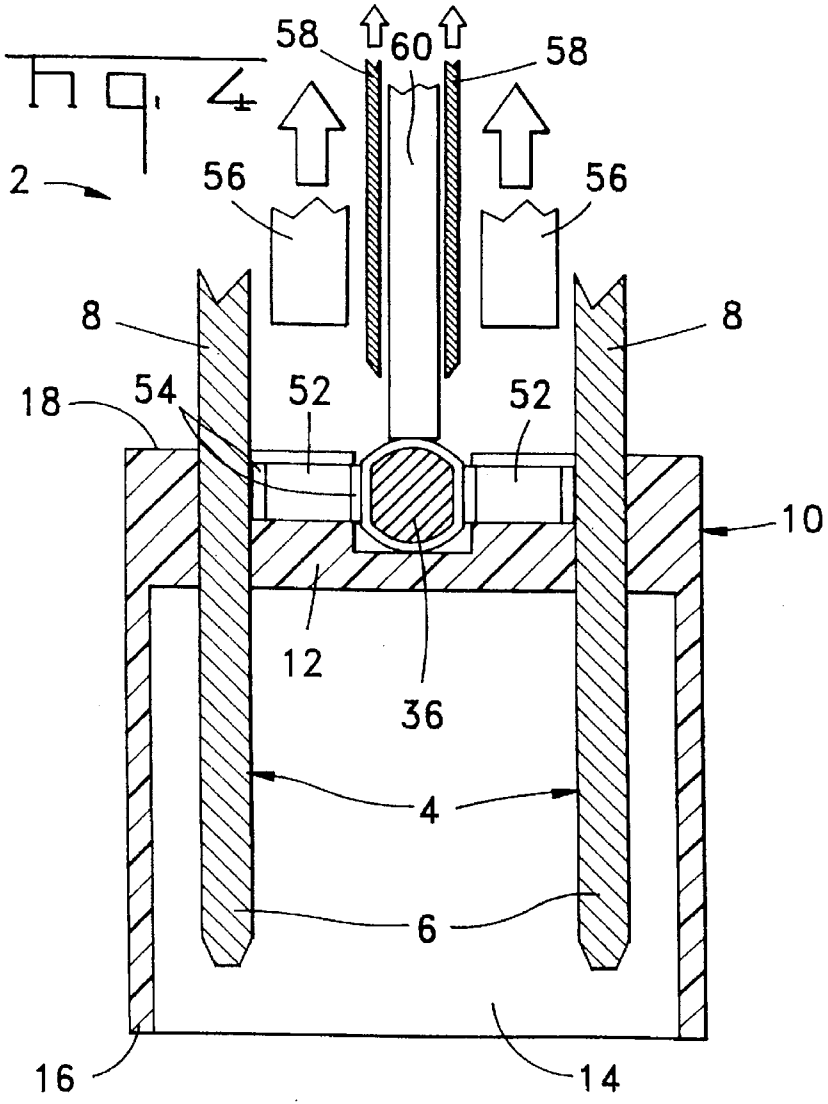
10
8
56
58
52
60
36
4
6
14
58
52
12
56
54
8
18
16
2
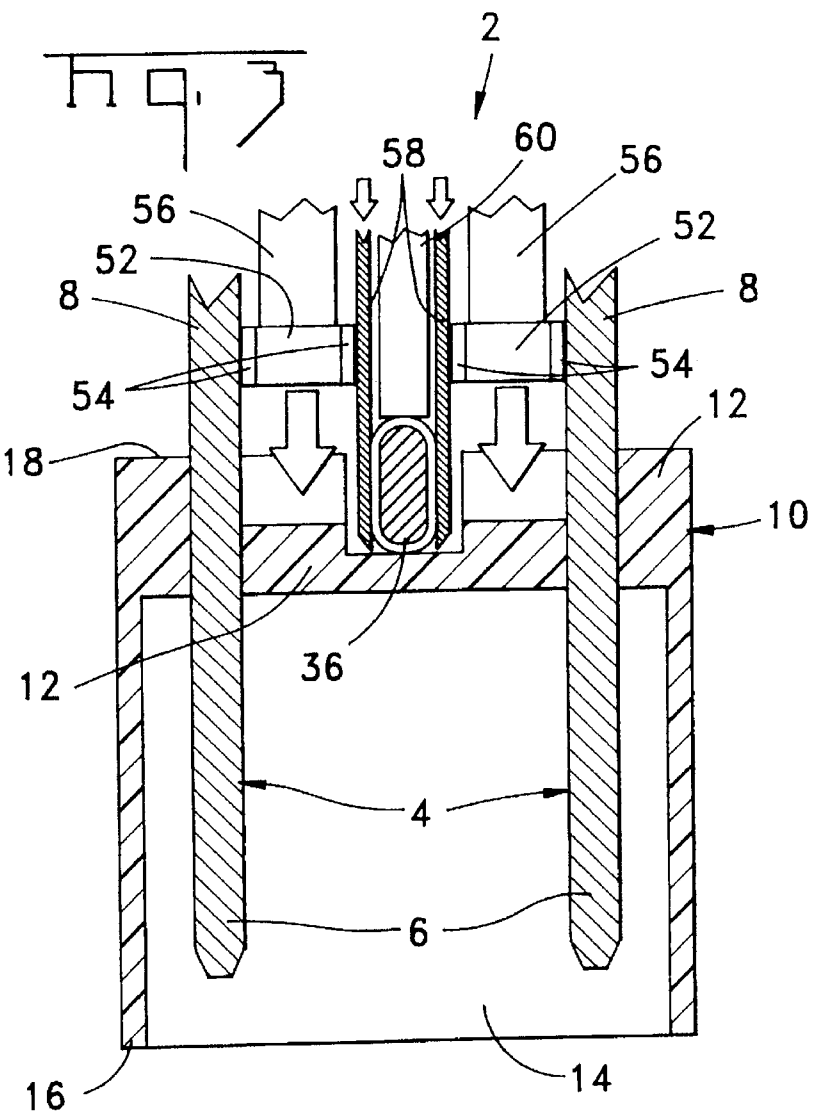
10
8
12
52
54
56
14
2
60
58
4
6
36
56
52
8
54
18
12
16

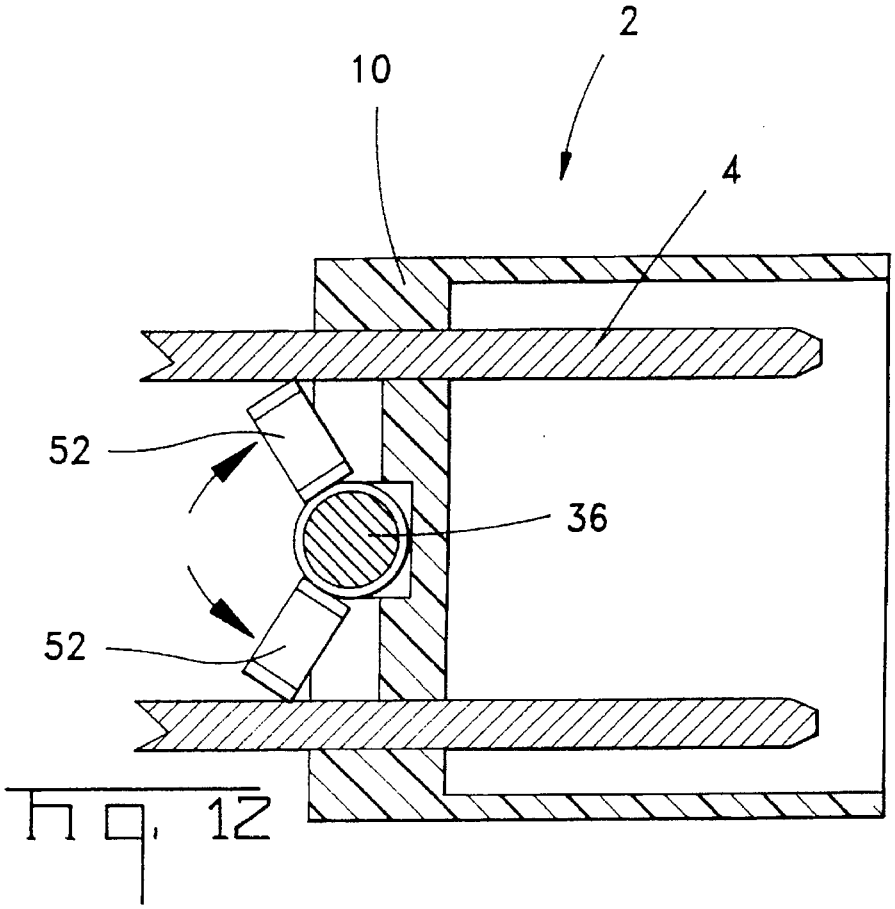
Fig. 12
Fig. 13
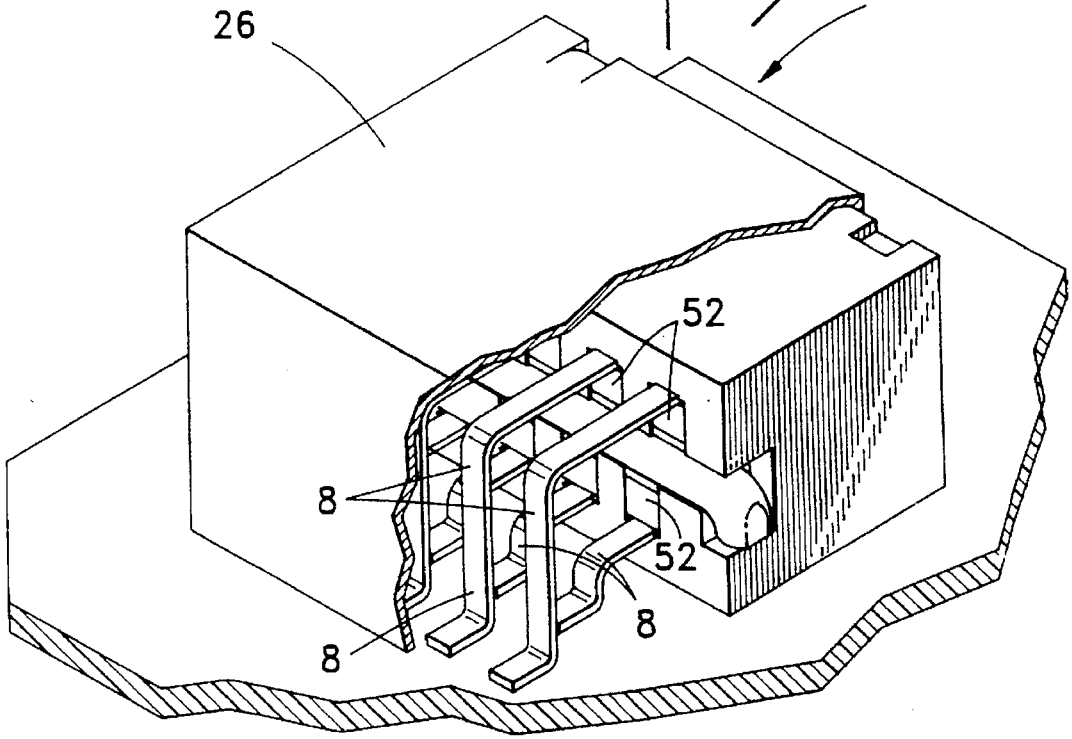

FILTERED AND SHIELDED ELECTRICAL CONNECTOR USING RESILIENT ELECTRICALLY CONDUCTIVE MEMBER

BACKGROUND OF THE INVENTION

1. Field of the Invention

The present invention relates to electrical connectors, and more specifically, to filtered and shielded electrical connectors in which discrete capacitors are positioned in the connector between contact terminals and ground. This invention also relates to other electrical connectors in which discrete electrical components are positioned in the connector. This invention is also related to the use of conventional chip components, such as surface mount capacitors, resistors, inductors, shorting links, fuses, diodes, light emitting diodes and other similar components, in electrical connectors. This invention is also related to the use of a resilient conductive member, such as an elastomeric member with an outer conductive surface, to connect components positioned in the connector to corresponding contact terminals and to a grounding surface or a shield.

2. Description of the Prior Art

Electrical connectors in which discrete electrical components such as capacitors, resistors, inductors, shorting links, fuses, diodes, light emitting diodes and other similar components, have become increasingly common. Filtered electrical connectors employing capacitors or other filtering elements are used to filter electromagnetic interference and radio frequency interference in noisy environments. One common method for including filtering in electrical connectors is to mount an auxiliary printed circuit board subassembly including capacitors, typically surface mount capacitors, on the electrical connector. Although there have been a number of prior art connectors of this general type, many of these prior art connectors have been relatively expensive to produce. There remains a need for filtered electrical connectors that use inexpensive components and standard assembly techniques so that the connector can be cost effectively produced.

Some electrical connectors employ a printed circuit board mounted to the connector housing. Discrete surface mount chip components are soldered to traces on this printed circuit board extending between a ground and the contact terminals soldered or press fit in through holes in the printed circuit board. Examples of such connectors are disclosed in U.S. Pat. No. 4,729,752 and in copending U.S. Pat. No. application Ser. No. 08/355,767 (Attorney's Docket. No. 16048) filed Dec. 12, 1994, which application is assigned to the assignee hereof.

Another approach to positioning surface mount capacitors in a connector is shown in U.S. Pat. No. 5,152,699 where the capacitors are positioned in depressions in a housing above or below plug pins. A ground plate having bent plate portions is located adjacent these depressions and is sandwiched between the housing sections. The capacitors can be soldered to the pins and to the bent out plate sections of the ground plate.

One approach to manufacturing filtered electrical connectors of this type has been to use standard chip components in standard Electronic Industries Association (EIA) packages, such as EIA 0603, EIA 0805 and EIA 1206 surface mount capacitors that are spring loaded in the connector. An example of the use of chip components urged by a spring into contact with a corresponding terminal are found in U.S. Pat. No. 5,151,054; U.S. Pat. No. 5,152,699; and U.S. Pat. No. 5,344,342. In U.S. Pat. No. 5,151,054 separate spring fingers are stamped in two plates located on either side of a two row electrical connector. In U.S. Pat. No. 5,152,699 fingers on a metal plate urge components into engagement with contact terminals. In U.S. Pat. No. 5,344,342 a metal ground plate includes a plurality of fingers on a ground spring that bias capacitors against signal contacts. This ground plate, spring, or clip is located along one side of the housing and the ground clip must include a ground tail that can be soldered to a ground contact in the connector. Apparently multiple ground plates must be used with multirow electrical connectors with this type of configuration.

Another approach is to solder a standard surface mount capacitor to a metal plate and to provide a spring on the plate to engage the contact terminals. One such approach is shown in U.S. Pat. No. application Ser. No. 08/401,594 (Attorney's Docket No. 16050) filed Mar 9, 1995, in the name of Gary R. Marpoe.

U.S. Pat. No. 5,340,335 shows another approach in which a compressible resilient conductive member is positioned in engagement with a surface mount chip component. The preferred embodiment of that compressible member is an elastomeric connector including an elastomeric core surrounded by a polyimide film with contact paths on the film. Products of this type are manufactured and sold by AMP Incorporated under the trademark AMPLIFLEX, which is a trademark of The Whitaker Corporation. The contact terminals are mounted in a printed circuit board, or similar substrate, and the chip component is biased into engagement with pads on the same printed circuit board by the compressible member. The compressible member also engages a flat surface of a ground plate or a shroud. Although this connector is suitable for such applications it does require the use of a number of parts including a printed circuit board. The compressible elastomeric connector also engages a flat ground plate. In order to insure adequate contact force, the thickness of this ground plate must be sufficient to prevent bowing or the width of the ground plate and connector must be limited. This connector also requires that the capacitors or similar chip components must be loaded endwise into passageways that extend between opposite faces of the connector housing. This endwise loading is not the typical way in which components are mounted on printed circuit boards using typical assembly techniques. Components of this type are normally mounted on their sides on printed circuit boards and conventional component assembly techniques handle the components in this manner.

The other prior art described herein and known to applicant also requires extra parts to assemble the components in the connector housing or unconventional assembly techniques. Extra assembly operations are thus required and additional manufacturing dies and molds are also required. Any additional step or part adds cost to the electrical connector and should be avoided if possible.

The instant invention eliminates both assembly techniques, such as soldering, and the use of printed circuit boards. This invention also makes use of such standard assembly techniques as pick and place insertion techniques that are desirable when assembling a large number of electrical connectors and handling a large number of electrical components, e.g., surface mount chip capacitors. Only simple dies are needed to manufacture the shields and ground plates employed with this invention and in some cases existing shields can be employed. No costly molds with core pins forming bores through molded housings are needed and thin housing walls are not required. Manufacturing operations are thereof not adversely affected by core pin breakage, and the incidence of defective molded parts caused by failure to fill the wall sections during injection molding operations is also reduced. This invention is also suitable for use with connectors having a large number of contacts since there is no tendency for the ground plate to bow near the center of long contact rows.

SUMMARY OF THE INVENTION

The foregoing limitations of the prior art are overcome by the instant invention which in its representative embodiment forms a shielded and filtered electrical connector that can be used as an input/output connector for printed circuit boards or in other applications. However, the connector does not include a printed circuit board subassembly as part of the connector nor does it require additional stamped components or additional molded components.

An electrical connector includes contact terminals positioned in a housing. The housing includes a channel and pockets on one face of the housing, preferably on the rear housing face. Chip components are positioned in the pockets and a resilient electrically conductive member is positioned in the channel. In the preferred embodiment of the invention the resilient electrically conductive member is a cylindrical elastomeric member having a continuous electrically conductive outer surface. The chip components are surface mount components having contact pads on each end. The pockets extend between the central channel and corresponding contact terminals so that a chip component positioned in a pocket is urged into contact with the corresponding terminal by the resilient electrically conductive member. The resiliently electrically conductive member can also make electrical contact with an external electrically conductive member in the form of a shield or a grounding plate. If the chip components are surface mount capacitors, these capacitors function to filter individual lines of the circuit of which the contact terminals form a part.

One method of connecting the resilient electrically conductive member to the shield is to trap the ends of the conductive member. The ends of the channel are open and the ends of the conductive member are bent over and trapped when the shield is mounted on the exterior of the connector. In one embodiment of the invention the shield has slots through which the contact terminals pass and the ends of the contact terminals can be formed after the shield is attached. Conventional pick and place assembly equipment and techniques can be employed to position the chip components and the resilient electrically conductive member in the pockets and channels on the rear of the housing. The channel and pockets on the rear face of the housing are accessible from the rear and no rotary movement is necessary to insert these components. The contact terminals extending from the rear face can be bent after insertion of these components if necessary.

BRIEF DESCRIPTION OF THE DRAWINGS

FIG. 2 also shows the manner in which contact terminals may be formed after insertion of the chip components and the resilient electrically conductive member.

FIG. 3 is a section view, and it shows the use of pick and place insertion equipment to position the chip components and the resilient electrically conducting member in the connector FIG. 4 is a view similar to FIG. 3 showing the retraction of the pick and place insertion equipment after the insertion step shown in FIG. 3.

FIG. 12 is a view of an alternate assembly method in which the individual surface mount components are rotated into position, compressing the resilient electrically conductive member during this insertion step.

FIG. 13 is a view of an alternate embodiment of this invention in which surface mount contact terminals are employed and in which the shield covers the contact terminals protruding from the rear of the housing.

DETAILED DESCRIPTION OF THE PREFERRED EMBODIMENTS

Figure 1:
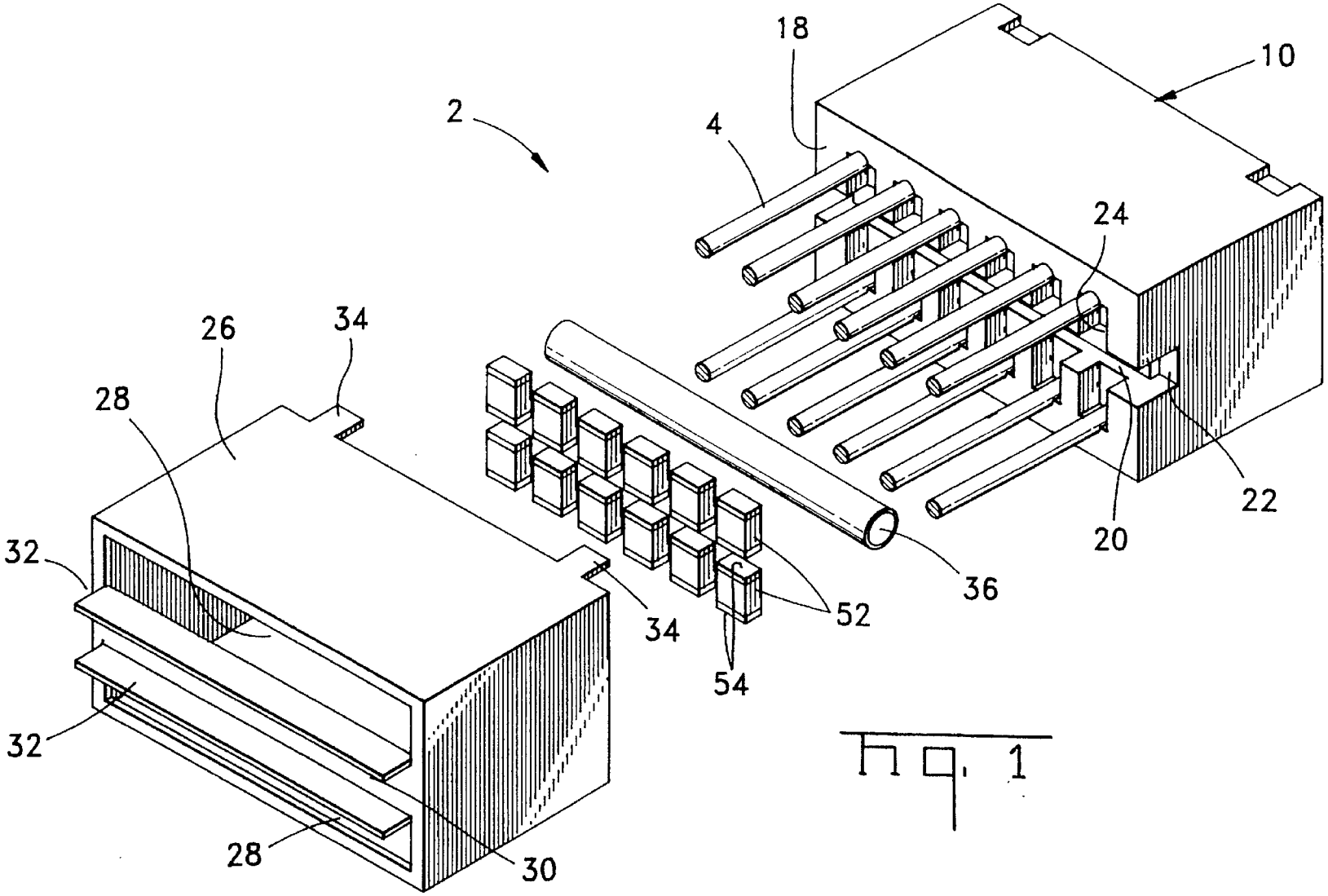
FIG. 1. is an exploded perspective view of a filtered and shielded connector in accordance with this invention. The individual components of this connector are shown.

The electrical connector 2 depicted herein is a representative embodiment of one part of a disconnectable connector assembly of the type employed in a number of applications, such as automotive, computer, instrument and other applications. This electrical connector 2 is intended to mate with another connector of conventional construction that is not shown. The embodiments depicted herein are in the form of a printed circuit board header that would be soldered to a printed circuit board. The mating electrical connector could be attached to a cable and mated with the printed circuit board header connector 2. Alternatively, the mating connector could also be a printed circuit board connector in which case the connector assembly would comprise a board to board connector. Electrical connector 2 is also in the form of a receptacle or female connector that would mate with a plug or male connector. The invention embodied by this receptacle connector is not limited to use in a female connector. One of ordinary skill in the art would appreciate that a plug or male connector, incorporating the elements of this invention, could be constructed using the teachings of this disclosure in conjunction with ordinary and well known techniques.

The electrical connector 2 depicted herein is also in the form of a filtered and a shielded connector. Although this preferred embodiment provides an effective method of incorporating both filtering and shielding into an electrical connector, it is not limited to applications requiring either shielding or filtering. For example, the shield included in the preferred embodiment of this invention could be replaced by a grounding member that would not shield the connector form external interference or prevent the connector from radiating energy to the surrounding environment. Filtering is also not the only application to which this application is applicable. For example light emitting diodes could be substituted for the capacitors used in the preferred embodiment. These light emitting diodes could then be used as a visual means for monitoring the operation of the circuit in which that connector was used or for diagnosing problems with that circuit. Other applications in which resistors, inductors, shorting links, fuses, diodes and other components could also use an electrical connector in accordance with the invention disclosed herein.

The electrical connector 2 comprises a plurality of contact terminals 4 positioned within a molded insulative housing 10. The housing 10 could be molded from a conventional plastic such as polybutylene terephthalate (PBT) and the physical configuration of the housing is simple and can be easily molded using conventional molding injection techniques. The contact terminals 4 depicted herein are fabricated using an electrically conductive material such as brass. Other materials can be employed to fabricate the terminals 4 and the housing 10.

The terminals 4 shown in the representative embodiment are in the form of round pins. Each pin includes a contact mating section 6 and a contact mounting section 8 extending beyond the rear face of the housing 10. Preferably the contact terminals 4 would be plated in a conventional manner. The contact mating section 6 would be plated with a material that would be suitable for use in establishing and maintaining a reliable mating connection that would withstand a number of mating and unmating cycles. A tin lead plating would be suitable for some applications and a noble metal plating could be employed for others. The mounting contact section 8 would also be plated. This plating would serve two purposes. First, the ends of the mounting section of this embodiment would have a tin lead plating suitable for use in establishing a solder connection with plated through holes with which a connector of the type shown as the preferred embodiment would be used. That portion of the mounting contact section 8 that engages the chip components 52, in the manner to be subsequently discussed in greater detail would also have a tin lead plating sufficient to maintain electrical continuity with the plated ends of the chip components 52. In other embodiments, the plating could be different. For example, a conventional press fit connection could be used on each contact terminal 4 to establish a solderless connection with a plated through hole. The plating requirements of the press fit configuration could differ form those of a through hole configuration. Similarly the plating requirements may differ if a surface mount solder tail is employed instead of a through hole solder connection. In any event the plating of the contact mounting section, including the portion engaging the chip components 52, would be conventional in nature. Contact terminals having a rectangular cross section or a square cross section could also be substituted for the round contact pins 4 depicted herein.

The molded housing 10 has a mating face 16 and an oppositely facing rear face 18. A mating cavity 14 extends into the housing of this receptacle connector from the mating face 16. A rear housing wall 12 is located at the rear of the mating cavity 14 and the mating contact section 6 extend from this rear housing wall 12 into the mating cavity 14 in conventional fashion. The contact terminals 4 extend through this rear housing wall 12 and are retained in the housing in this wall by conventional means. Although not shown, the contact terminals could be retained in the housing wall 12 by press fit means the contact terminals could be insert molded in the housing. Conventional latching configurations could also be used, especially for stamped and formed contact terminals. One of the significant advantages of this invention is that it can be used with a wide variety of contact terminal configurations and contact anchoring means and places no significant limitations on the selection of contact terminal configurations or contact mounting configurations. In this embodiment, the contact terminals 4 are located in two laterally extending parallel rows.

In this embodiment the rear face 18 is the rearwardly facing external face of the housing wall 12. The mounting contact sections 8 extend beyond the rear face 18. A laterally extending channel 20 is located in the center of the rear face 18 between the two rows of contact terminals 4. This channel extends between the two sides of the rear face 18 and both channel ends 22 are open on the side of the of the housing 10. As shown in FIG. 1 these channel ends preferably extend for a short distance along the sides of the housing 10 toward the mating face 16. The channel 20 is also open in the rearwardly facing direction along its entire lateral extent so that it is accessible for assembly operations. Pockets 24 are also located on the rear face 18 on both sides of the central channel 20. Each pocket 24 extends from the central channel 20 to a corresponding contact terminal 4 extending form the rear wall 12. In the preferred embodiment, each of these pockets is generally rectangular and is sized to receive one of the chip components 52 to be inserted therein. It should be understood that pockets of other shapes and sizes could also be suitable and that in some applications the pockets 24 could comprise an extension of the channel 20. The pockets could also comprise portions of a continuous recessed surface, but means to properly position the individual components in this uninterrupted continuous recessed surface would be necessary. In any event the channel 20 and the pockets 24 are relatively shallow and can therefore be easily molded without creating thin internal housing walls that might be weak and difficult to reliably mold. Simple mold inserts could also be used in the same basic mold if selected pockets were to be eliminated for specific applications. For example if components were to be eliminated in selected positions, a mold insert corresponding to that position could be removed from the mold so that location would be filled with plastic during the molding stage. Alternatively, plastic blocks the same size as the components could be inserted in molded pockets if necessary.

As previously mentioned, the preferred embodiment depicted herein is a shielded connector. The preferred shield 26 comprises a stamped and formed member that encloses the housing 10. The shield 26 includes laterally extending slots 28 located on its rear surface to provide clearance for the mounting contact sections 8 extending therethrough. For the two row contact configuration of this embodiment, a center strap 30 extends laterally between the two slots 28. Strap 30 is positioned over the channel 20 when the shield is assembled to the housing 10. The material stamped and formed to open the slots 28 is folded back to form flanges or ribs 32 that add rigidity to the center strap 30 to reduce its deflection. The shield 26 also includes shield tabs 34 on its forward edge to secure the shield to the housing 10. Shield 26 can be plated in a conventional fashion. In this embodiment, the shield 26 does not require any mounting or grounding tabs to connect the shield directly to the printed circuit board. The shield itself can be grounded by connection to one or more ground pins or terminals in the connector itself as will be subsequently described in more detail. Although a separate grounding tab could be included in the shield, its elimination can be important in applications where printed circuit board space is at a premium. The elimination of grounding or mounting tabs also can eliminate an extra assembly step.

The filtering achieved with this electrical connector is achieved by positioning capacitors in the form of conventional chip components or surface mount capacitors 52 between each or selected contact terminals 4 and a ground reference, here provided by the shield 26. The connection between the capacitors 52 and the contact terminals 4 is established by using a resilient electrically conductive member 36. The preferred embodiment of this resilient electrically conductive member 36 is a compressible connecting member having an elastomeric core 38 with a polyamide film 40 surrounding the core 38. An electrically conductive laminate 42 is located on the exterior of film 40. In the preferred embodiment a layer of conductive material, such as copper, is bonded to the film 40 and this conductive laminate 42 makes electrical contact with the capacitors 52. The conductive laminate 42 is a continuous ground layer in the preferred embodiment. This connector has substantially the same construction as a commercially available electrical connector manufactured and sold by AMP Incorporated as the AMPLIFLEX connector. AMPLIFLEX is a trademark of The Whitaker Corporation. In most commercial embodiments that elastomeric connector has traces formed on the exterior of the film so that closely space electrical contacts may be interconnected without shorting adjacent contacts. In the embodiment used herein the conductive laminate layer 42 is intended to common or ground adjacent contacts so the layer 42 is continuous between both ends of the cylindrical electrically conductive member 36. In other applications, however, the conductive laminate can be etched to connect only selected contact terminals to ground through the capacitors 52. Indeed one of the advantages of this invention is that different circuit configurations can be accommodated by different etching patterns of the conductive laminate layer 42 and still using the same hardware components including the contact terminals 4 and housing 10. For instance some of the contact terminals can be connected to ground through capacitors 52 while other circuits can be connected to each other, but not to ground, by using shorting links and an appropriately etched conductive laminate layer 42. The conductive member 36 can also be used to connect multiple terminals at the same potential, for example ground potential, to each other, without requiring a separate grounding member, also by using an appropriately etched conductive laminate 42.

Figure 9:
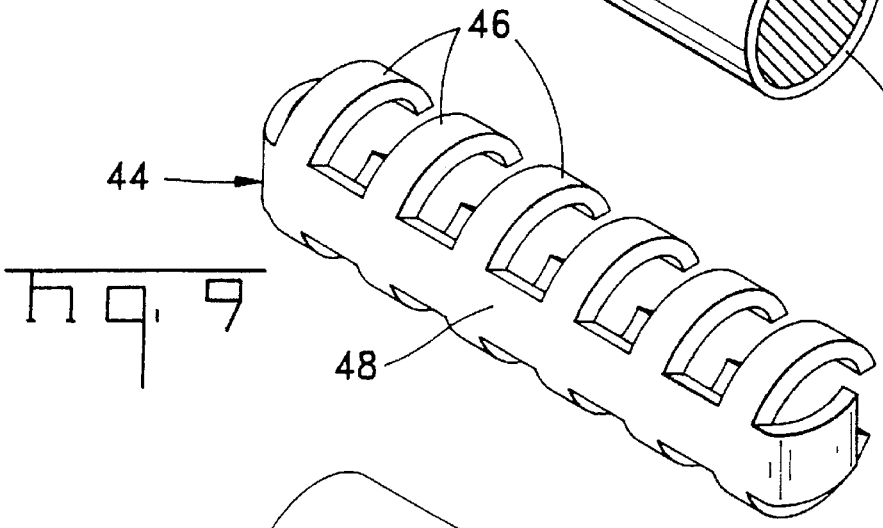
FIG. 9 is a perspective view of an alternate embodiment of the resilient electrically conductive member comprising a stamped and formed member having spring members.
Figure 10:
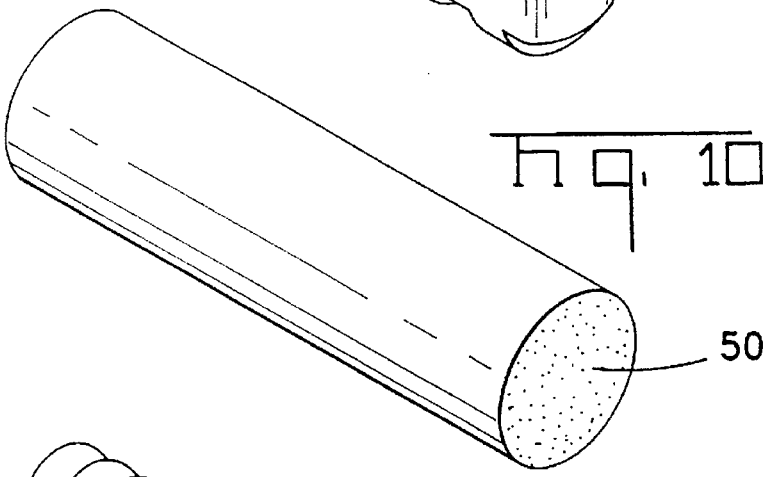
FIG. 10 is a perspective view of another alternate embodiment of the resilient electrically conductive member comprising a conductive elastomer.
Figure 11:
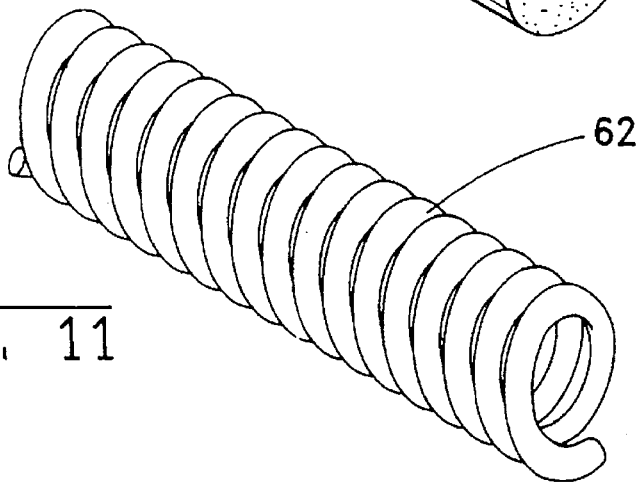
FIG. 11 is a perspective view of a fourth embodiment of the resilient electrically conductive member comprising a canted coil spring.

Other versions of the resilient electrically conductive member can also be used for the application for which the preferred embodiment is employed. For example, a stamped and formed cantilever spring 44 having spring fingers 46 extending from a central backbone or base 48 could be substituted for the elastomeric conductive member 36. This cylindrical cantileven spring 44 is shown in FIG. 9. A conductive elastomer 50 in which conductive material, such as conductive particles, fibers or carbon, is embedded in the elastomeric material as shown in FIG. 10 could also be employed. A canted coil spring 62 as shown in FIG. 11 could also be substituted for the cylindrical connector member 36. These alternate embodiments would not however offer the same selective circuit advantages as the preferred embodiment.

The chip components 52 used in this invention comprise standard mass produced components that provide an inexpensive way to add filtering to an electrical connector. The most common use for components of this type is as surface mount components for use directly on a printed circuit board. The capacitors 52 that are used in the filtered embodiment of this electrical connector are representative of the types of components that can be used. These surface mount capacitors are rectangular in shape and each component includes conductive pads 54 on each end. These pads 54 include a coating or plating that is typically forms part of a surface mount solder joint. Components having a tin-nickel coating are available and are preferred for use in this application. This invention, however, uses the resilient electrically conductive member to bias the surface mount capacitors into engagement with the plated surface of a contact terminal 4. The resilient conductive member 36 exerts enough force to maintain a satisfactory spring loaded electrical connection between one end 54 of the surface mount capacitor and the adjacent contact terminal 4 while at the same time maintaining a satisfactory electrical connection between the other end of the capacitor and the conductive laminate on the outer surface of the resilient member 36. The surface mount capacitors 52 employed in the preferred embodiment of this invention are standard Electronic Industries Association (EIA) packages. Depending upon the size of the connector 2 and the spacing between adjacent contacts 4, the following EIA packages could be employed: EIA 0402, EIA 0603, EIA 0805 and EIA 1206. Each of these standard packages is rectangular in cross section and has a length that is greater than the width and height. Therefore two side surfaces (defined in part by the length and width dimensions) will be relatively larger than the other two surfaces (defined by the length and height dimensions). These larger side surfaces are generally the top and bottom when these components are solder to a printed circuit board. It is conventionally easier to manipulate and place these components in this orientation and this invention takes advantage of that feature. The maximum dimensions for EIA 0805 ceramic capacitors are 0.080×0.050×0.050 inch (2.0×1.2×1.2 mm). The dimensions for EIA 1206 ceramic capacitors are 0.125×0.063×0.060 inch (3.2×1.6×1.5 mm). Actual components meeting these specifications may not correspond to these maximum dimensions.

Figure 2:
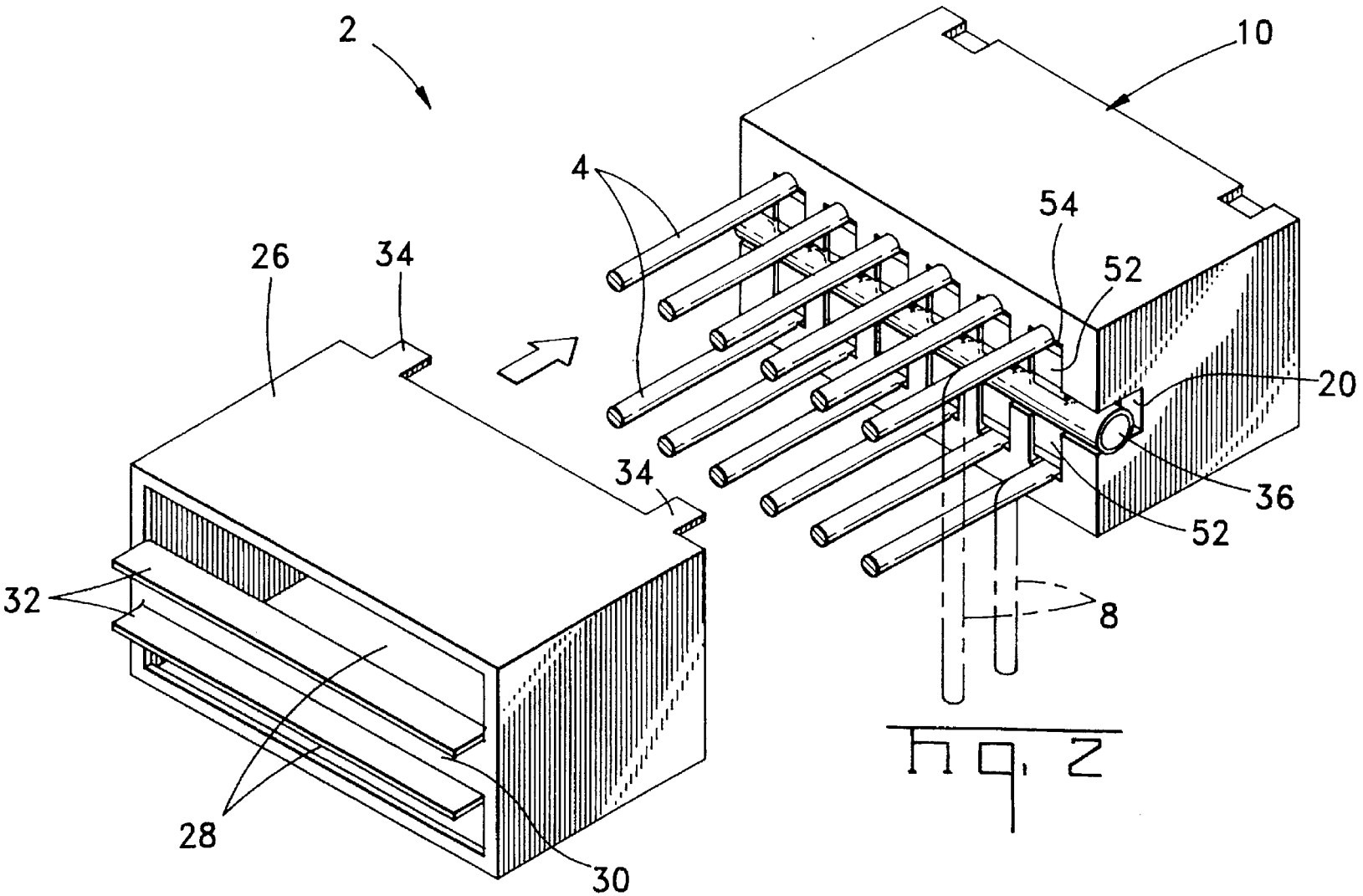
FIG. 2 is a perspective view of the electrical connector showing the chip components and the resilient electrically conducting member positioned in pockets and channels on the rear face of the connector.
Figure 5:
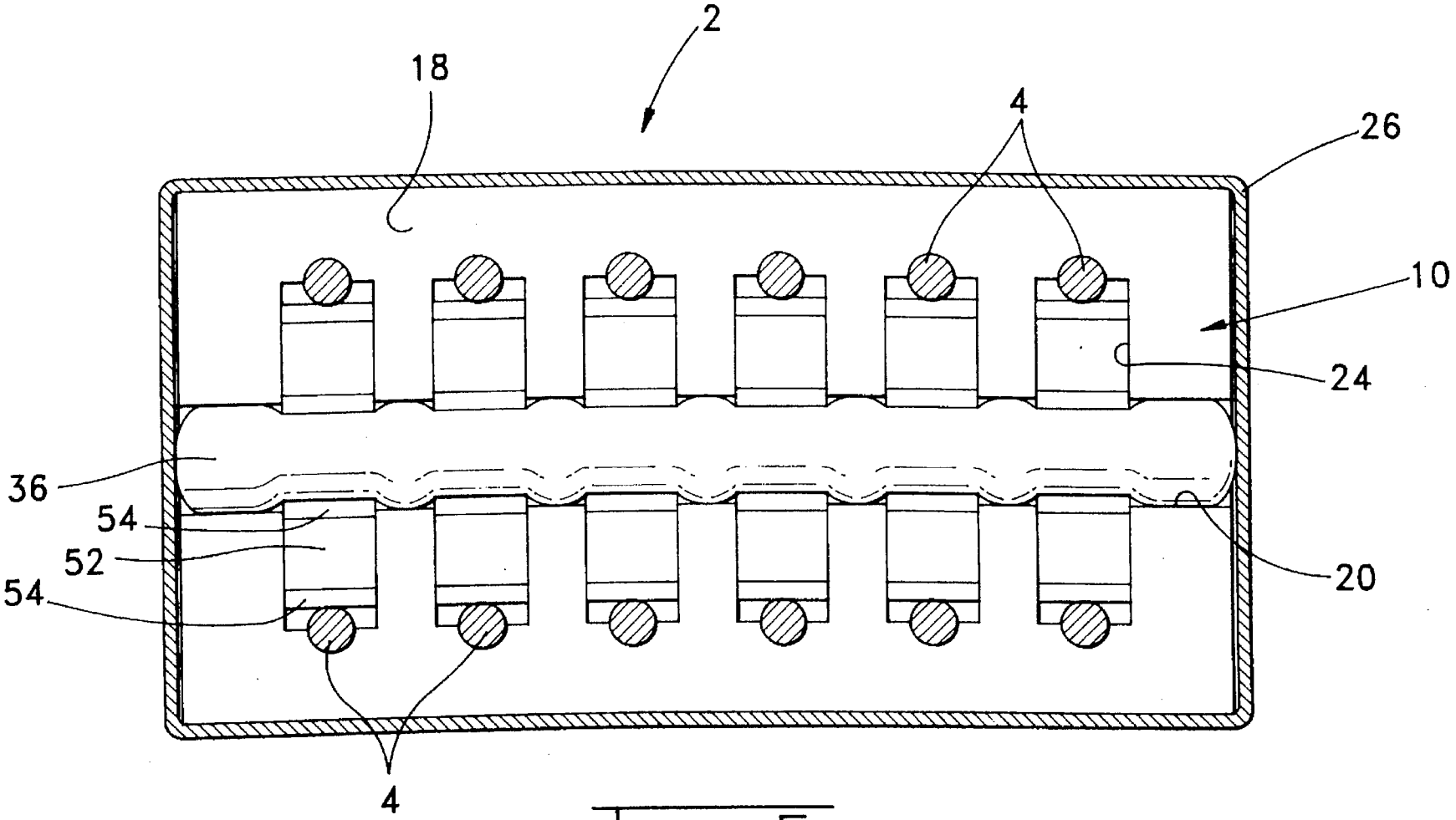
FIG. 5 is a rear view or the rear connector face, partially in section, showing the manner in which the resilient electrically conductive member urges the chip components into electrical contact with the pin terminals.
Figure 6:
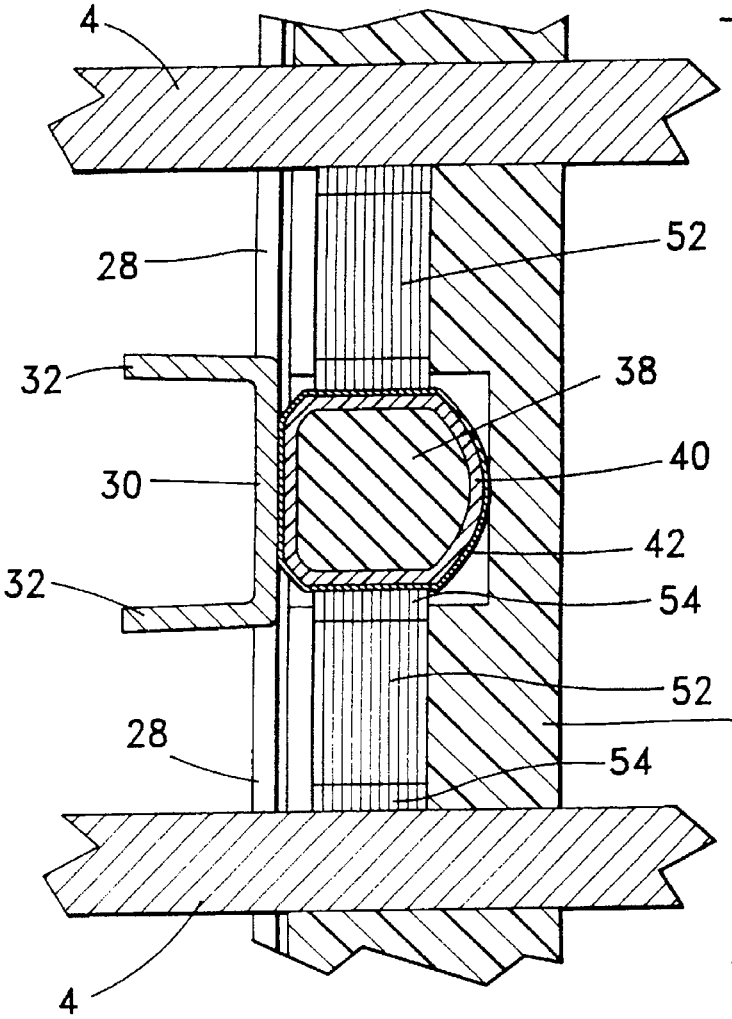
FIG. 6 is an enlarged section view showing the elements of the elastomeric connector that comprises the preferred embodiment of the resilient electrically conductive member and shows the electrical contact of this elastomeric connector with two surface mount capacitors that form the preferred embodiment of the chip components.

The position of the channel 20 and the pockets 24 on the rear face 18 of the housing 10 makes them accessible from the rear so that the resilient electrically conductive member 36 and the chip components 52 can be easily loaded in the connector 2. Conventional pick and place assembly techniques can therefore be used to assemble the conductive member 36 and the chip components 52 in the connector. Since no rotary movement or manipulation of the components is necessary these pick and place techniques can be inexpensively employed. FIGS. 3 and 4 show two steps in one representative pick and place assembly sequence. FIG. 3 shows the insertion of two chip components on opposite sides of the central conductive member 36. Note that the conductive member 36 is placed in channel 20 and is laterally compressed by pick and place clamping members 58. Compression of conductive member 36 provides clearance for insertion of the two chip components 52 into pockets on either side. In this configuration vacuum pick-up fingers 56 are used to load the chip components. These vacuum pick up members 56 engage the relative larger sides of the chip components 52 between conductive ends 54. Component gripping members could also be employed in conjunction with the vacuum pick up or alone. After the chip components 52 are positioned in pockets 24, the clamping members 58 are withdrawn as shown in FIG. 2. A center stripping member 60 abuts the rear of the conductive member 36 as the clamping members 58 are withdrawn to strip the conductive member from between the clamping members 58 during withdrawal. As shown in FIG. 5 the elastomeric core of the conductive member 36 laterally expands to partially return to its initial shape. The conductive member then engages the conductive ends 54 of chip components 52 on each side and biases the chip components 52 into contact with contact terminals 4. Since the elastomeric member 36 is prevented from completely returning to its neutral or stress free configuration, the elastomeric member 36 continues to exert a spring or biasing force. The force exerted against the chip components 52 is sufficient to securely hold these components in place even in the presence of vibration and of typical g-forces that would be expected in applications such as the use of this connector in automotive electronics. Although only two positions are shown in FIGS. 3 and 4, it should be understood that components could be assembled one at a time or mass inserted into position using these conventional assembly techniques.

It should be understood that the assembly steps shown in FIGS. 3 and 4 are merely representative of standard pick and place assembly techniques that could be employed. Other standard pick and place assembly steps could also be employed. For example the chip components 52 could be temporarily secured in place by an adhesive and the elastomeric member 36 could be subsequently inserted between the two opposed chip components 52. Of course that option would require that the elastomeric connector exert sufficient force to dislodge the temporary adhesive connection of the chip components so that they could be biased into contact with the contact terminals 4. The chips can also be held in place by ultrasonically staking or heat staking the plastic ribs surrounding the pockets 24. Other pick and place techniques could also be employed. Certain applications could require that the cross section of the elastomeric member be some shape other than the circular cross section employed in the preferred embodiment.

Although this invention is compatible with pick and place assembly techniques in which the components are loaded without rotary movement, the components can still be rotated into position. FIG. 12 shows one alternate technique in which the chip components are rocked into place. This technique has the advantage of compressing the elastomeric member 36 only during insertion of the chip components although it may require more complex insertion equipment. This approach is not incompatible with pick and place assembly since this rotation of the chip components could be imparted with requiring rotation of the assembly equipment.

Insertion of the resilient electrically conductive member 36 and the chip components 52 from the rear is not incompatible with connectors in which the contact mounting section 8 are formed in some shape other than the straight configuration. Straight contact terminals 4 are the best shape for component insertion. The contact mounting section 8 can, however, be formed after component insertion. Forming contacts after insertion into the housing is quite common and the intermediate step of inserting the resilient electrically conductive member 36 and the chip component 52 will not interfere with bending the terminals. As shown in FIG. 2 contact mounting section can be bent at right angles so that the connector can be used as a right angle header, perhaps the most common configuration for a connector of this type.

This invention is also compatible with other more complex post bending operations. FIG. 13 shows an alternative embodiment in which the contact terminals 4 are bent initially at right angles. The ends of the contact terminals can also be bent to form gull wing surface mount solder pads, a common surface mount configuration. There are advantages with forming these gull wings with solder pad in a post bending operation. By forming the gull wing solder pads as a final step, coplanarity of the solder pads can be maintained. This coplanarity is quite important for connectors containing a relatively large number of contact terminals in long rows where bowing or warping of the housing may prevent pre-bent contacts from remaining in the same plane and can result in poor solder surface mount solder joints.

The embodiment of FIG. 13 also shows several other advantages of this invention. In this embodiment contacts in the two rows are staggered. The resilient electrically conductive member 36 can still be placed between two rows of contact terminals and offset chip components 52 can still be positioned between the conductive member 36 and the contact terminals 4. FIG. 13 also shows the use of contact terminals 4 having a rectangular cross section. Another feature of the embodiment of FIG. 13 is that the shield 26 employed in that alternate embodiment encloses not only the housing, but also encloses the otherwise exposed contact mounting sections 8. In especially noisy applications this additional shielding may become significant. Note that a larger shield of this type can also be used for through hole connectors.

Figure 7:
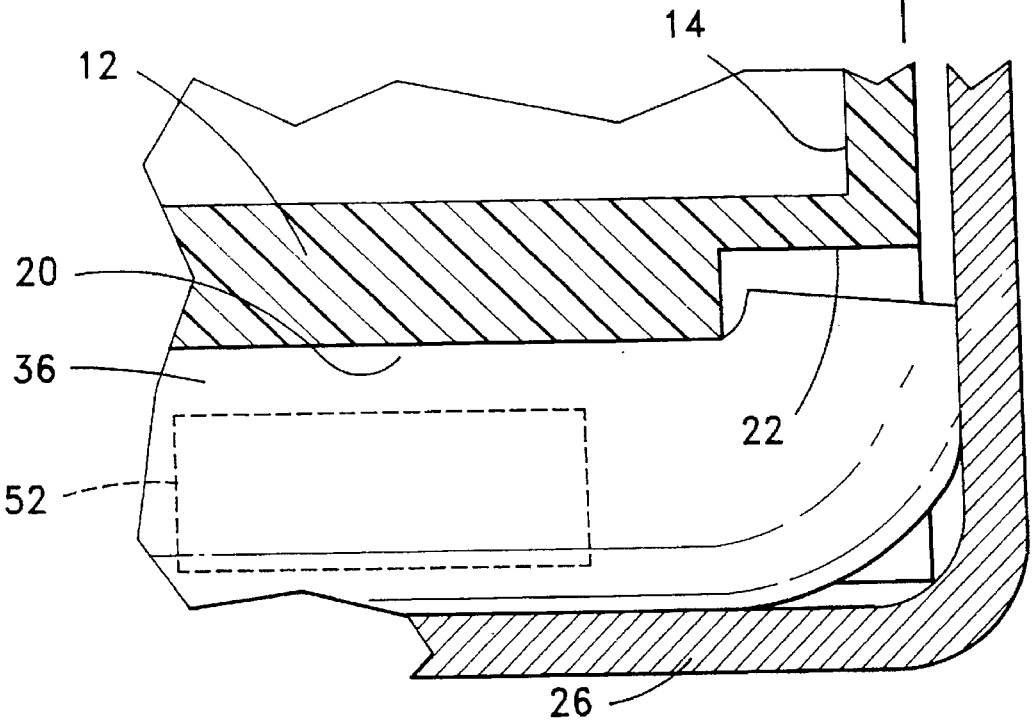
FIG. 7 is an enlarged section view partially in , section, showing the manner in which the shield or grounding member engages the ends of the elastomeric connector to establish an effective grounding connection.
Figure 8:
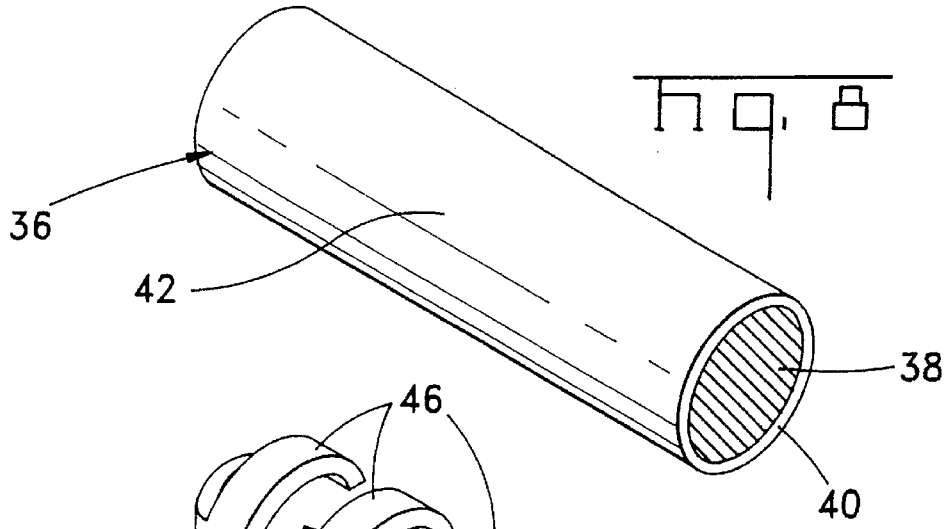
FIG. 8 is a perspective view of the elastomeric connector showing the continuous electrically conductive laminate on the exterior of the connector.

The shield can be extended in this manner because the principle electrical contact or interface between the shield and the resilient electrically conductive member occurs on the ends of the connector and not along its rear surface. As shown in FIG. 7 the ends 22 of the channel 20 are open. When the shield is placed on the connector the ends of the resilient electrically conductive member 36 are trapped by the sides of the shield 26. Since an elastomeric core 38 of the type employed in the preferred embodiment can maintain acceptable force over a relative large deflection, this engagement can be reliably maintained even in the presence of relatively large dimensional variations and over time. In the preferred embodiment, the shield 26 is inserted into position from the rear before the contact terminals 4 are bent into their final configuration. The ends of the conductive member 36 are therefore bent forward by the forward movement of the shield 26. The center shield strap 30 may also engage the conductive member 36 but for wider connectors this shield strap may be bowed and it may not be possible to maintain adequate contact force. Portions of the shield strap 30 could however be embossed or bent inward to establish better contact with the conductive member 36.

In the alternate embodiment of FIG. 13, the shield would be inserted after the contact terminals are formed and the shield could therefore be inserted from the top forcing the trapped ends of the conductive member down. With this alternate embodiment, the shield could even be attached after the connector is soldered to a printed circuit board because no direct connection is required to the board where the resilient electrically conductive member makes contact through a shorting link (substituted for a capacitor) with one or more contact terminals. Since pick and place equipment is easily programmable, substitution of different chip components is a simple task.

Figure 14:
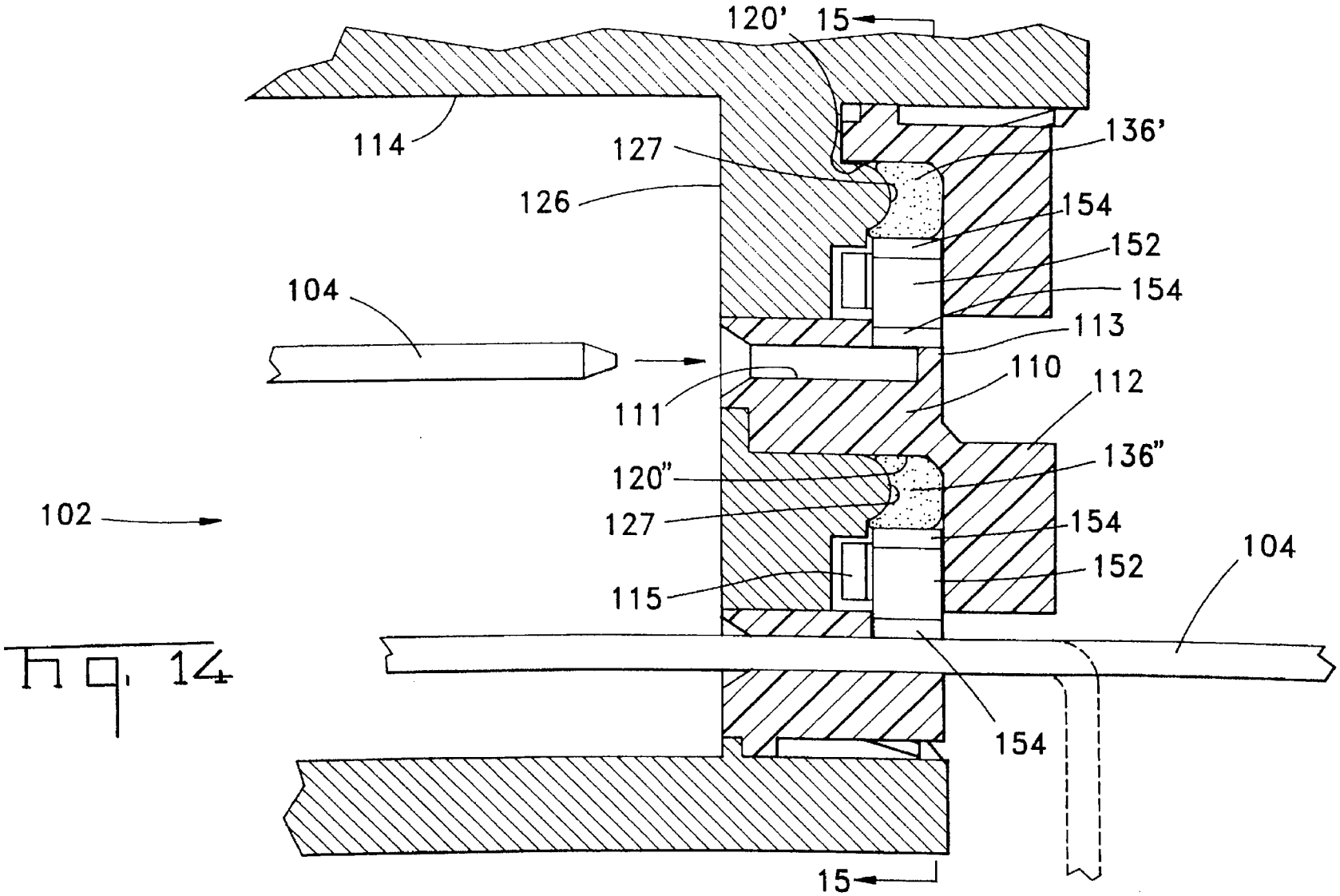
FIG. 14 is a side sectional view of another alternate embodiment of a connector employing two electrically conductive elastomers in a housing insert that is positioned in a die cast metal shroud or shielding housing.
Figure 15:
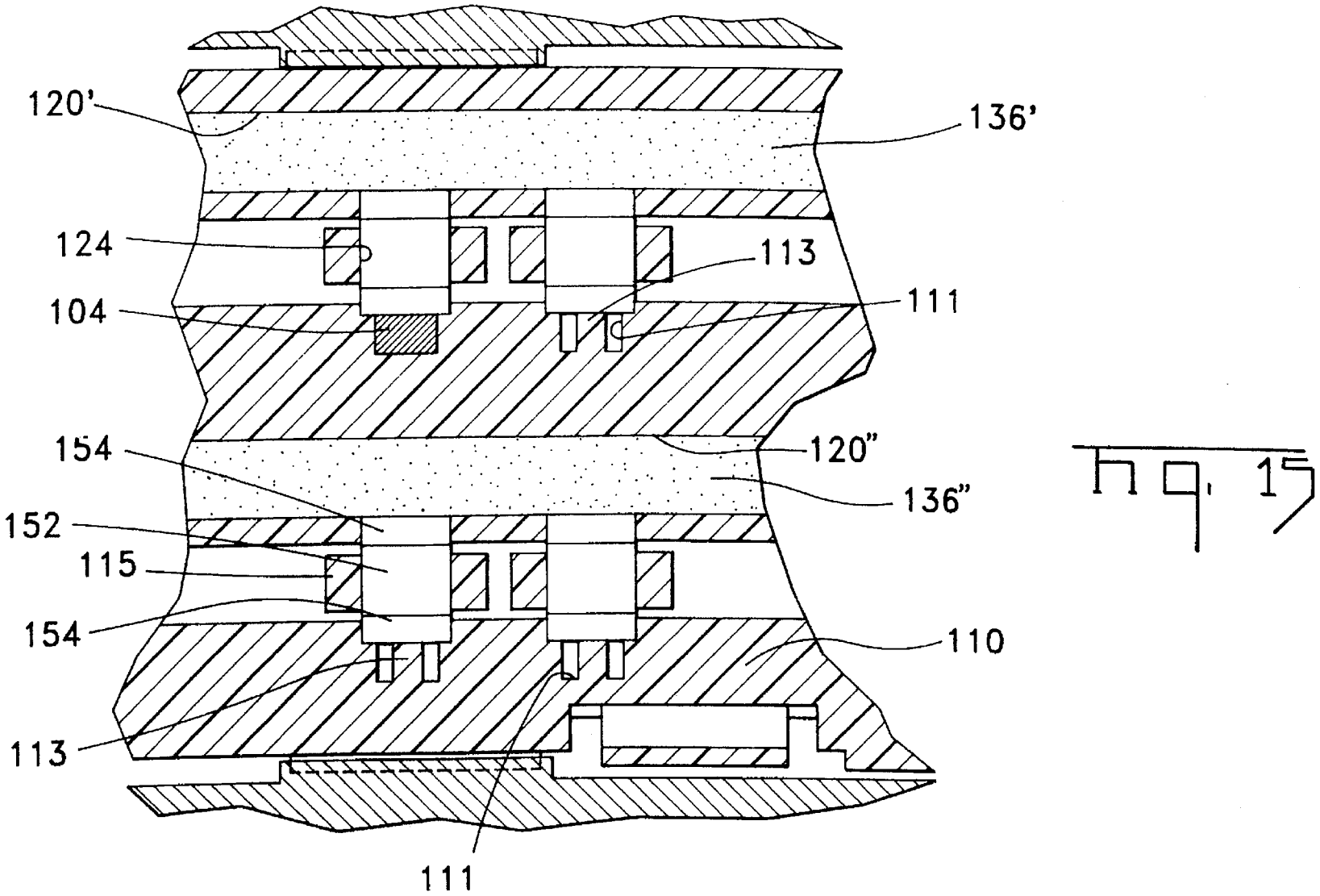
FIG. 15 is a cross sectional view taken along section lines 15—15 in FIG. 14 showing the relative positioning of two rows of chip components and two conductive elastomers.

Another alternate embodiment of this invention is shown in FIGS. 14 and 15. This alternate embodiment employs two conductive elastomers 136' and 136" to bias two rows of chip components 152 into engagement with contact terminals 104 located in two rows. In this embodiment, the conductive elastomers 136' and 136" are formed by dispersing conductive material, such as silver flakes, into an elastomeric body of silicon or other material in sufficient quantity to render this resilient member electrically conductive. Other resilient electrically conductive members, such as the film-laminate-elastomeric core member used in the first embodiment could also be employed. This connector 102 also employs a different shielding configuration. The outer shield in this embodiments is provided by a die cast housing 126, formed of a material such as zinc. An insulative housing insert 110 is positioned in the die cast shielding housing 126 and can be held in position by conventional snap fastening means. Unlike the housings of the other embodiments, the insert housing 110 does not include a mating cavity formed by a peripheral shroud. In this embodiment, the die cast shielding housing 126, which is in the form of a header, includes a shroud defining the mating cavity 114. The contact terminals 104 are still mounted in the plastic insert housing 110, however. The use of a die cast metal header housing, that functions as a shield, with a plastic insert housing, such as housing 110, is conventional.

With this embodiment, the chip components 152 and the resilient electrically conductive members, here represented by two conductive elastomers 136' and 136", are still inserted into pockets 124 and channels 120' and 120" on one face of the housing. However in this embodiment, the housing face on which the pockets 124 and the channels 120', 120" are located faces forward in the assembled connector. This face is however accessible for insertion of chip components 152 and conductive elastomers 136', 136". Each of these components is inserted into housing 110 before the die cast shielding housing 126 is mated with the plastic insert housing 110.

In this embodiment, the chip components 152 and the conductive elastomers 136' and 136" are inserted prior to insertion of the contact terminals 104, which are normally inserted after the plastic housing insert subassembly is positioned in the die cast shielding housing 126. This embodiment includes molded flexible retention members 115 and the chip components 152 are inserted into the pockets 124 formed by opposed retention members 115. Both the chip components 152 and the conductive elastomers 136' and 136" can be loaded into pockets 124 and channels 120', 120" by conventional pick and place techniques or by other conventional assembly methods.

The insert housing 110 includes breakaway tabs 113, initially spanning contact cavities 111. These tabs 113 support the chip components 152 prior to insertion of the terminals 104 into cavities 111. The contact terminals 104 are inserted into the housing 110, from the left as shown in FIG. 14, through the forwardly facing beveled entry section of the contact cavities 111. Conventional terminal stitching assembly equipment can be used to insert these terminals 104. Insertion of the contact terminals severs the breakaway tabs 113 and positions the contact terminals 104 in position to engage one conductive end 154 of a corresponding chip component 152. Since the corresponding conductive elastomer 136' or 136" is initially compressed the chip components will now be in electrical contact with the corresponding contact terminals 104. The contact terminals 104 can be bent into a final configuration after insertion into cavities 111 as shown.

After assembly of the chip components 152, the conductive elastomers 136' and 136" into the insert housing 110 to form an insert subassembly, the die cast shielding housing 126 can be assembled to the insert subassembly. Insert housing 110 is inserted into die cast housing 126 and snapped into position. The die cast housing 126 includes an inner wall that engages the insert housing 110 and traps the conductive elastomers 136', 136" and the chip components 152 in position. The die cast housing inner wall 129 includes protrusions 127 located to engage and to compress the corresponding conductive elastomer 136', 136" which either initially imparts or adds to the force exerted by the conductive elastomer 136', 136" on the chip components 152 and in turn on the contact terminals 104 to form a reliable electrical connection. Of course the die cast metal housing 126 serves as the ground reference in this configuration in the same manner as the stamped and formed shields 26 of the other embodiments. Although this alternate embodiment employs two conductive elastomers 136' 136" as resilient electrically conductive members, a similar configuration using a single conductive elastomer or other resilient electrically conductive member positioned between two rows of chip components and two rows of terminals could be employed in the die cast housing approach, in much the same manner as in the other embodiments.

The representative embodiments of this invention specifically disclosed herein are not the only embodiments that would incorporate the elements of this invention and would be apparent to one of ordinary skill in the art as a result of this disclosure. This invention is especially useful for printed circuit board connectors, but it is not so limited. Cable to cable connectors could also incorporate this invention. For example a cable connector using insulation displacement technology could incorporate the same resilient conductive elements and chip components positioned in a channel and pockets between outwardly facing insulation displacement contact sections. This invention is also not limited to use with dual row connectors and could be used with single row connectors or with connectors having more than two rows. The rows need not be straight as depicted herein and could be offset. Also connectors having contact terminals omitted at selected positions, in accordance with common practice, could also employ this invention. Therefore the invention as defined by the following claims is not limited to the specifically disclosed representative embodiments and would be applicable to variations that would be within the skill of one of ordinary skill in the art.

I claim:

1. An electrical connector comprising:

a housing, the housing comprises conductive members, and electrical component receiving areas;

a resilient conductive member disposed in a portion of said electrical component receiving areas, between said conductive members;

at least two electrical components disposed laterally of said resilient conductive member, on opposed sides of and in electrical engagement with said resilient member;

each electrical component is biased against a respective conductive member by spring-like forces which are generated by the resilient conductive member, as said resilient conductive member presses on said electrical components;

whereby said electrical components are each pushed into electrical contact with a respective conductive member.

2. The electrical connector of claim 1 wherein said resilient conductive member comprises a conductive portion that is in electrical engagement with a conductive shield portion of said electrical connector.

3. The electrical connector of claim 1 wherein said resilient conductive member comprises an elongated shape, and pairs of electrical components are pressed thereagainst within said electrical component receiving areas.

4. The electrical connector of claim 1 wherein said resilient conductive member comprises an elastomeric portion surrounded by conductive traces.

5. The electrical connector of claim 1, wherein said resilient conductive member comprises a spring.

6. The electrical connector of claim 1 wherein said resilient conductive member comprises a conductive synthetic material.

7. The electrical connector of claim 1 wherein said resilient conductive member comprises a cantilever spring base.

8. The electrical connector of claim 1 wherein said resilient conductive member is received in a channel of said housing, and said electrical components are received in pockets of said housing, which pockets are in communication with said channel.

* * * * *